US005465423A

United States Patent [19]

Taylor-Varney

[11] Patent Number: 5,465,423

[45] Date of Patent: Nov. 14, 1995

[54] BODY PROTECTIVE VEST

[76] Inventor: Martha Taylor-Varney, 66 Ham Rd., Barrington, N.H. 03825

[21] Appl. No.: 60,687

[22] Filed: May 12, 1993

Related U.S. Application Data

[63] Continuation of Ser. No. 833,461, Feb. 7, 1992, abandoned.

[51] Int. Cl.[6] ..... A41D 13/00

[52] U.S. Cl. ..... 2/2; 2/44; 2/92

[58] Field of Search ..... 2/44, 92, 2, 267, 2/268, 105, 108, 69

[56] References Cited

U.S. PATENT DOCUMENTS

| | | | |
|---|---|---|---|
| 3,076,197 | 2/1963 | Glahe | 2/2 |
| 3,125,762 | 3/1964 | Glahe | 2/2 |
| 4,084,264 | 4/1978 | Marion | 2/2 |
| 4,100,620 | 7/1978 | Pecoraro | 2/102 |
| 4,302,847 | 12/1981 | Miles | 2/2 |
| 4,884,295 | 12/1989 | Cox | 2/2 |
| 5,020,156 | 6/1991 | Neuhalfen | 2/2 |

OTHER PUBLICATIONS

Custom Tipperary Vest manufactured by Tipperary Sport Products, Inc. P.O. Box 375 Orangeville, Canada and Pony Clubber manufactured by Tipperary Sport Products.

The Casel–Equi body protector manufactured by Casel–Equi Inc., 330 Rang Des Patriotes Napierville JoJILO P. Quebec, Canada.

*Primary Examiner*—Clifford D. Crowder
*Assistant Examiner*—Gloria Hale
*Attorney, Agent, or Firm*—Hayes, Soloway, Hennessey, Grossman & Hage

[57] ABSTRACT

A body protective vest for sports use has a front panel and a back panel joined at the shoulders and side panels. The front panel and back panel include inner and outer plies having elongate padding inserts held in place between the inner and outer panels by line stitching. The padding inserts on the front panel are angled diagonally and held in place by diagonal line stitching which permits the front panel to yield and fold as the wearer assumes different positions.

12 Claims, 3 Drawing Sheets

BODY PROTECTIVE VEST

This is a continuation of application Ser. No. 07/833,461 filed on Feb. 7, 1992 now abandoned.

FIELD OF THE INVENTION

This invention relates generally to body protective clothing, and more particularly, to body protective vest including strategically located foam pads for protecting the upper body from impact injuries. The invention has particular utility for use in mitigating soft tissue injury in equestrian sports and will be described in connection with such utility, although other utilities are possible.

BACKGROUND OF THE INVENTION

Various protective devices have been developed for use in protecting the wearers during sports activities. For example, baseball catchers have long been provided with well padded vests. However, such devices are generally cumbersome, unwieldy, heavy or interfere with performance and thus have not achieved widespread use, particularly amongst sports involving substantial body movements such as equestrian sports.

In order to satisfy equestrian user's needs, various manufacturers have developed and offer for sale body protective vests such as shown in FIGS. 1 to 3. As shown in FIGS. 1 and 2, the vest is formed with a front panel 10 joined at shoulders 12 and 14 and side panels 16 and 18 to a back panel 20. Front panel 10 comprises a two piece panel joined by a central fastening means such as hook and loop fasteners or a soft nylon zipper 22 running vertically from top to bottom. Adjustable straps 24 bridge the side panels 16 and 18. Referring also to FIG. 3, front panel 10 and back panel 20 typically comprise an outer shell 30 and an inner shell 32. Impact absorbing resilient foam inserts 34 are held in place between shells 30 and 32 by stitching 36 which runs vertically along the front and back panels. While prior art protective garments such as shown in FIGS. 1 to 3 have been shown to mitigate soft tissue injury, the vests have a tendency to ride up particularly when the user bends forward, for example, when jumping on horseback. While shortening the length of the front panel 10 reduces the problem of ride-up, shortening the panel also reduces the area of protection and is thus not desirable.

SUMMARY OF THE INVENTION

The present invention overcomes the aforesaid and other problems of the prior art by providing a protection vest comprising a front and back panel joined at the shoulders and sides as in the case of prior art protective vests. However, unlike prior art protective vests, the foam inserts on the front panel are set at a diagonal. Setting the front foam panels at a diagonal permits the vest to fold along the stitched crease lines, thus enabling the wearer to assume various postures without causing the vest to ride-up.

BRIEF DESCRIPTION OF THE DRAWINGS

Further objects and features and advantages of the present invention will be more fully appreciated by reference to the following detailed description of a presently preferred but nevertheless illustrative embodiment in accordance with the present invention taken in conjunction with the accompanying drawings wherein like numerals depict like parts, and wherein.

DESCRIPTION OF THE PREFERRED EMBODIMENT

Figure 2:
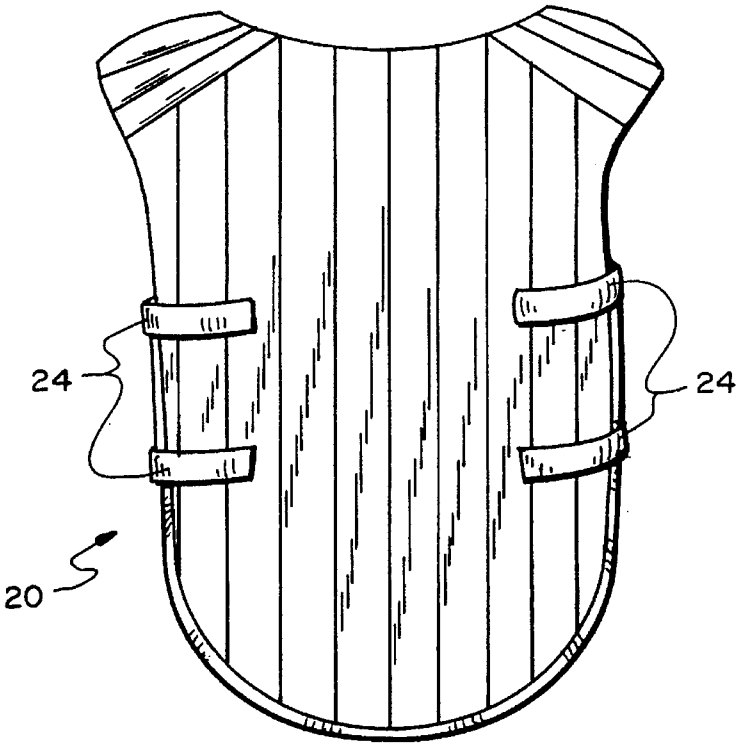
FIG. 2 PRIOR ART
FIG. 2 is a rear elevational view of the vest of FIG. 1.
Figure 1:
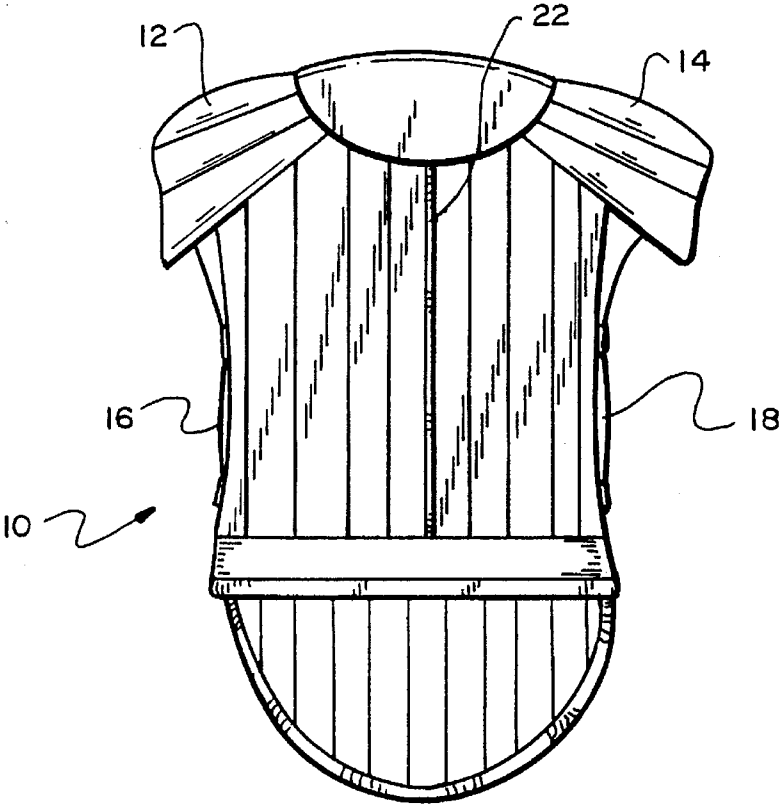
FIG. 1 PRIOR ART
FIG. 1 is a front elevational view of a protective vest made in accordance with the prior art.
Figure 6:
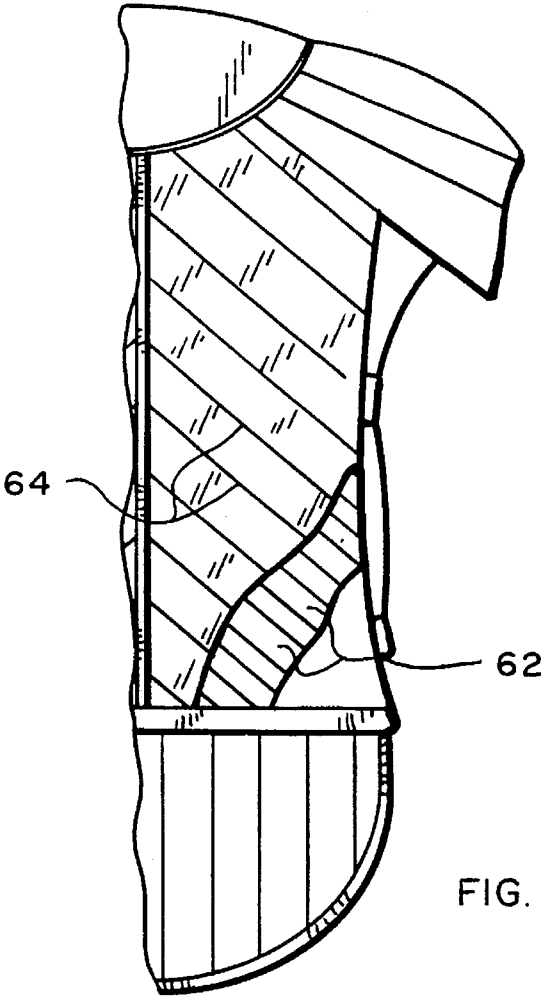
FIG. 6 is a front elevational view of a portion of the protective vest of FIG. 4, partially broken away to expose various layers.
Figure 3:
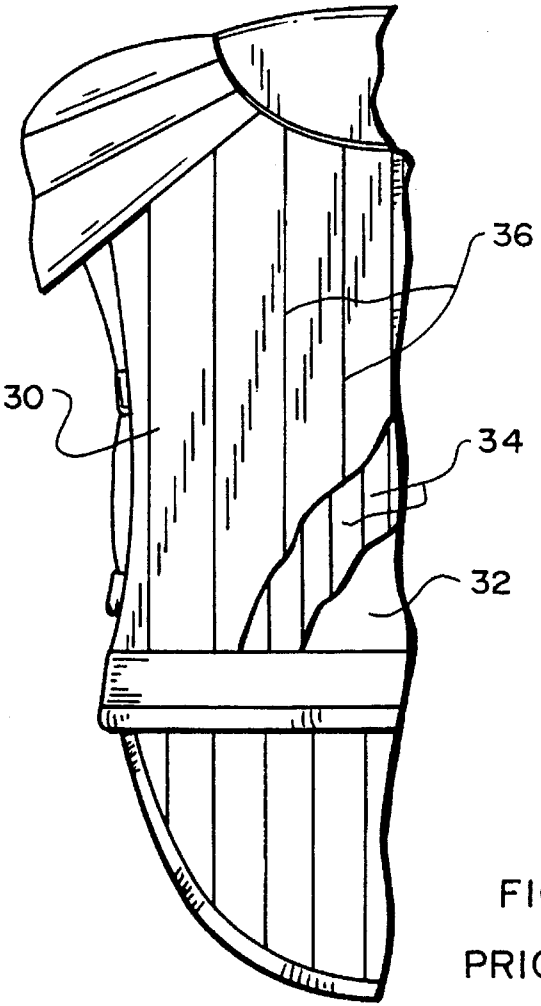
FIG. 3 PRIOR ART
FIG. 3 is a front elevational view of a portion of the vest of FIG. 1, partially broken away to expose various layers.
Figure 5:
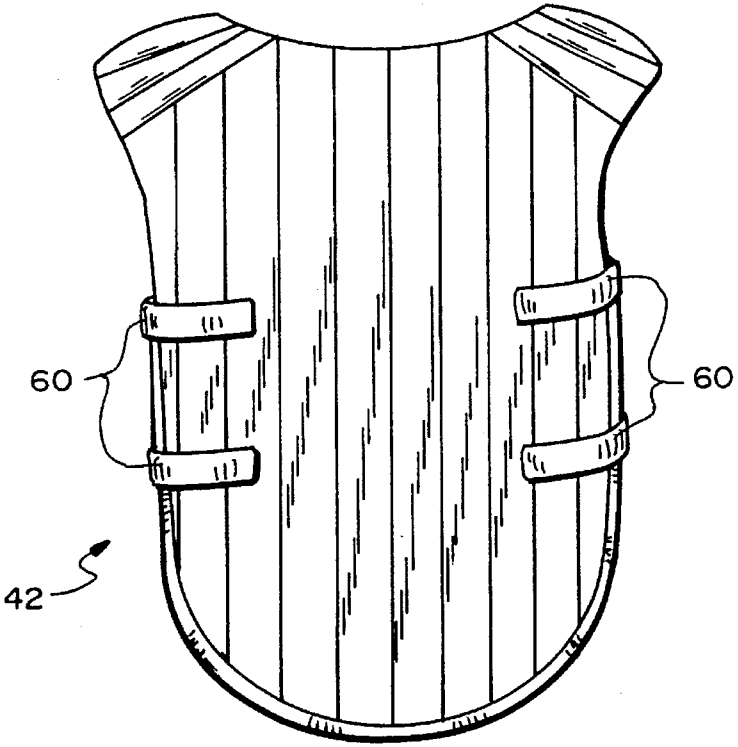
FIG. 5 is a rear elevational view of the vest of FIG. 4.
Figure 4:
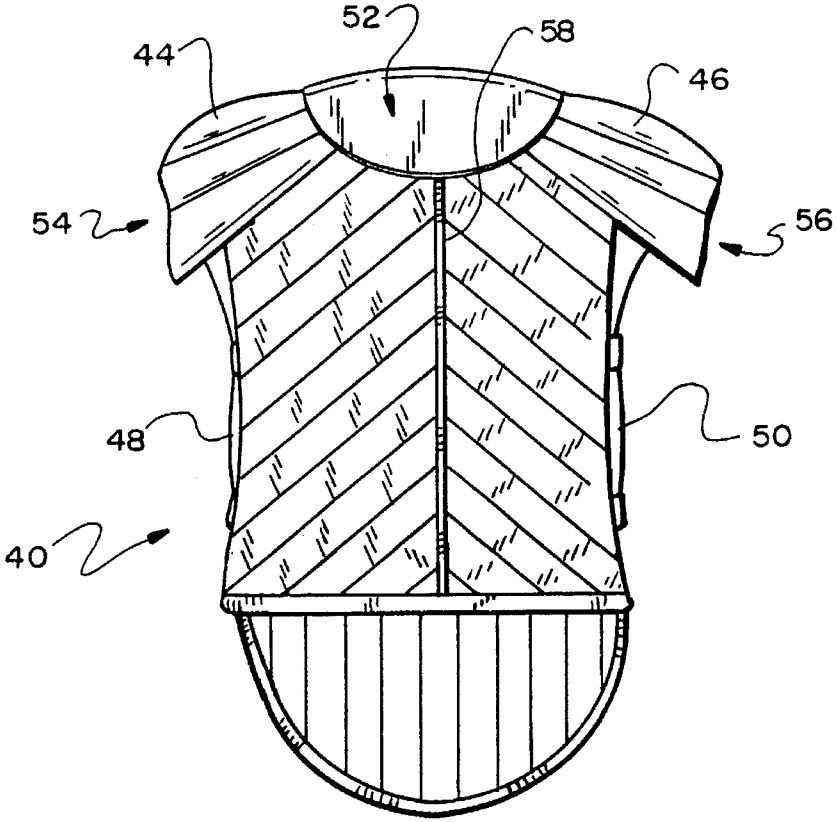
FIG. 4 is a front elevational view of a protective vest made in accordance with the present invention.

Referring to FIGS. 4 to 6, the protective vest in accordance with the present invention is in the form of a vest having a front panel 40 and a back panel 42 joined at the shoulders 44, 46 and side panels 48 and 50. The vest has a neck opening 52, arm openings 54 and 56. As in the case of prior art vests, front panel 40 comprises a two piece panel joined by a central fastening means 58 running vertically from top to bottom. Also as in the case of prior art vests, adjustable straps 60 preferably are provided on side panels 48 and 50.

The front panel 40, back panel 42 and shoulder panels 44 and 46 each comprise inner and outer shells fastened together by a suitable means, for example, stitching. Foam inserts 62 are held in place between the inner and outer panels by line stitches 64, or the like.

A feature and advantage of the present invention is the ability of the user to freely move without causing the vest to ride up. According to the present invention, the foam inserts 62 on the vest front panel 40 are fitted at a diagonal with diagonal crease lines 64 which permit the otherwise semi-rigid liner to yield and fold as the wearer assumes different positions. Crease lines 64 may be at an angle in the range of about 20–70 degrees, preferably 25–60 degrees, more preferably 30–40 degrees from the horizontal.

Various changes may be made in the invention without departing from the spirit and scope of the invention. For example, the foam inserts padding may be replaced by a bulk fiber padding such as acrylic or polyester fiber, bulk cotton fiber or the like.

While the invention has been described as particularly suited for equestrian sports use, it will be appreciated that the vest advantageously may be used for protecting against injury in other sports such as skiing, roller skating, ice skating, skateboarding and the like, in which the participant is subjected to soft tissue injury by impact, or falls.

It is therefore intended that the invention is to be limited only by the scope of the claims appended hereto.

We claim:

1. A body protective vest for sports use, operable at the front, and comprising, in combination, a front panel and a back panel joined at the shoulders and side panels, wherein the front panel and back panel comprise inner and outer plies having a plurality of elongate padding inserts held in place between the inner and outer plies by line stitching, the front panel comprising two pieces joined by a central, vertically running fastening means, and wherein the padding inserts on the vest front panel extend diagonally, running from said vertically running fastening means to said back panel and side panel, and are held in place by diagonal line stitching.

2. A body protective vest according to claim 1, wherein said diagonal lines are at an angle in the range of about 20–70 degrees from the horizontal.

3. A body protective vest according to claim 1, wherein said diagonal lines are at an angle in the range of about 25–60 degrees from the horizontal.

4. A body protective vest according to claim 1, wherein said diagonal lines are at an angle in the range of about 30–40 degrees from the horizontal.

5. A body protective vest according to claim 1, wherein said plurality of elongate padding inserts are parallelepiped in shape and said padding comprises foam inserts.

6. A body protective vest for sports use comprising, in combination, a front panel and a back panel joined at the shoulders and side panels, wherein the front panel and back panel comprise inner and outer plies having a plurality of elongate padding inserts held in place between the inner and outer plies by diagonal line stitching, and wherein the elongate padding inserts on the vest front panel extend diagonally running from a central line running vertically on the vest front panel to said back panel and side panel and are held in place by diagonal line stitching.

7. A body protective vest according to claim 6, wherein said diagonal lines are at an angle in the range of about 20–70 degrees from the horizontal.

8. A body protective vest according to claim 6, wherein said diagonal lines are at an angle in the range of about 25–60 degrees from the horizontal.

9. A body protective vest according to claim 6, wherein said diagonal lines are at an angle in the range of about 30–40 degrees from the horizontal.

10. A body protective vest according to claim 6, wherein said plurality of elongate padding inserts are parallelepiped in shape and said padding comprises foam inserts.

11. A body protective vest according to claim 6, wherein the front panel comprises two pieces joined at said central line.

12. A body protective vest according to claim 11, wherein said two pieces are joined at said central line by a vertically running fastening means.

* * * * *